US006832761B2

(12) United States Patent
Young

(10) Patent No.: US 6,832,761 B2
(45) Date of Patent: Dec. 21, 2004

(54) FLEXIBLE MEDIA PUSHER FOR IMAGE FORMING DEVICE

(75) Inventor: Stanley S. Young, Vancouver, WA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 134 days.

(21) Appl. No.: 10/391,151

(22) Filed: Mar. 18, 2003

(65) Prior Publication Data

US 2004/0183250 A1 Sep. 23, 2004

(51) Int. Cl.[7] ..... B65H 5/16
(52) U.S. Cl. ..... 271/271
(58) Field of Search ..... 271/271

(56) References Cited

U.S. PATENT DOCUMENTS 3,897,053 A * 7/1975 Guy ..... 271/238
5,409,209 A * 4/1995 Nakamura et al. ..... 271/271
5,964,461 A * 10/1999 Ende et al. ..... 271/271

FOREIGN PATENT DOCUMENTS

JP 4-373354 * 12/1992 ..... H04N/1/00

* cited by examiner

*Primary Examiner*—Donald Walsh
*Assistant Examiner*—Kenneth W. Bower

(57) ABSTRACT

In one embodiment, an image forming device includes an image forming mechanism for forming an image onto print media. The device includes a media pusher having at least one flexible arm for moving the imaged media along a media path.

22 Claims, 2 Drawing Sheets

FLEXIBLE MEDIA PUSHER FOR IMAGE FORMING DEVICE

BACKGROUND

In some imaging devices, paper pushers have been incorporated into the paper path in order to help eject printed media from the imaging device and into an output tray. In prior devices, the paper pushers were formed of a hard plastic that occasionally broke when hit by other components of the imaging device. The paper pushers also broke at times when jammed print media was removed by a user such that the media caught onto the paper pusher and broke it while the user was pulling the media.

The present invention provides a new and useful flexible media pusher.

BRIEF DESCRIPTION OF THE DRAWINGS

In the accompanying drawings, which are incorporated in and constitute a part of the specification, embodiments of a system and method are illustrated which, together with the detailed description given below, serve to describe the example embodiments of the system and method. It will be appreciated that the illustrated boundaries of elements (e.g. boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vise versa.

DETAILED DESCRIPTION OF ILLUSTRATED EMBODIMENTS

Figure 1:
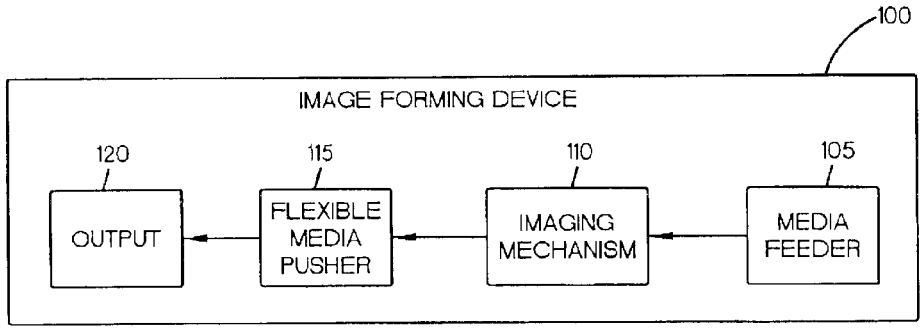
FIG. 1 illustrates one embodiment of an image forming device including a flexible media pusher.

Illustrated in FIG. 1 is one embodiment of an image forming device 100. The image forming device 100 may be a printing device such as a laser printer, an inkjet printer, a copier, an all-in-one product, a multifunctional peripheral (MFP) device, or other type of imaging device that forms an image onto print media. A media feeder 105 may be provided that is configured to move print media from an input position to an imaging mechanism 110 where an image is formed onto the print media. The image forming device 100 may include one or more media paths along which the print media is carried.

The imaging mechanism 110 may be embodied in a variety of different ways depending on the type of image forming device 100. For example, the imaging mechanism 110 may include a laser imaging mechanism, an inkjet mechanism, a thermal printing mechanism, a digital image reproduction mechanism, or other type of printing mechanism. Once the print media is imaged by the imaging mechanism 110, the print media is moved along a path to where a media pusher 115 continues to move each print media further along the path, for example, out to an output 120. The output 120 may be one or more output trays or other devices from which a user can receive the imaged print media. It will be appreciated that the term "pusher" and "push" are used to represent movement in general and that the media pusher can be configured in other embodiments to pull or otherwise move the print media along a media path in other ways as desired.

In one embodiment, the media pusher 115 is positioned and configured as an ejection mechanism in the image forming device to assist with the ejection of the print media. In some imaging devices, media rollers (not shown) positioned downstream from the image forming mechanism 110 do not always fully eject the print media from the imaging device 100. In one embodiment, to apply a force to the print media in order to eject it, the media pusher 115 includes one or more flexible arms configured to contact and move the print media. The arm(s) are formed of a flexible material such that they can bend and may withstand contact from other components of the image forming device 100. By being flexible, the media pusher 115 can have a reduced likelihood of permanent damage or breakage.

As an illustrative example, the media pusher 115 is typically positioned relatively close to other components of the imaging mechanism 110. For example, in an inkjet printer, the media pusher 115 may be located next to an inkjet pen and its carriage. In some situations, the carriage may hit the media pusher 115. In this case, the flexible media pusher 115 would bend during contact and return to its original position when the contact is removed. In another example, when a media jam occurs and the media is removed by force, the media may catch onto the media pusher 115. Since the media pusher 115 is flexible, it may withstand contact from these types of components with a reduced likelihood of breakage. In one embodiment, the media pusher 115 may be formed of a flexible material that has a shape memory such that it will return to its original state after being bent or otherwise deformed.

Figure 2:
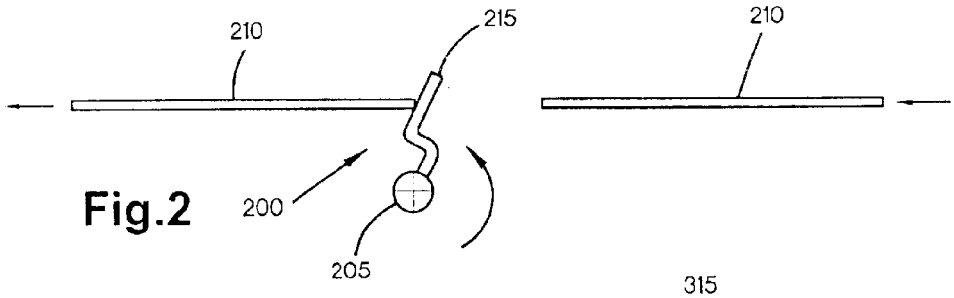
FIG. 2 illustrates a side view of a flexible media pusher and print media.

Illustrated in FIG. 2 is a side view of one embodiment of a media pusher mechanism 200. The mechanism 200 includes a supporting device such as a shaft 205, or other type of supporting device, that is configured to support and move the mechanism 200 in order to move the print media along a media path. In one embodiment, the shaft 205 is configured to rotate between a start position and an end position. The rotation is coordinated and timed with the movement of each sheet of print media 210 as it moves along a media path represented by the arrows. A drive mechanism (not shown) can be provided to supply the desired force to the shaft 205.

With further reference to FIG. 2, an arm 215 projects out from the shaft 205 and is configured to contact and move the print media 210 as the shaft 205 rotates. Of course, multiple arms may be included. In this manner, the arm 215 assists with the ejection of the print media 210 to an output position by applying a force to the trailing edge of the print media. In another configuration, the media pusher mechanism 200 may be configured to frictionally engage a surface of the print media and move it in that manner. It will be further appreciated that the term "arm" is used generally throughout the disclosure to represent an element that is configured to engage the print media. It may be any type of element that extends or projects from the shaft 205 or other supporting device.

As the leading edge of the next piece of print media approaches, the pusher mechanism 200 moves the arm 215 out of the media path such as by rotating back to the start position. As the next sheet passes, the shaft 205 is rotated and the arm 215 moves into contact with the trailing edge of the next sheet to eject the sheet. In one embodiment, the pusher mechanism 200 rotates in one direction from the start position to the end position and rotates in a reverse direction to return to the start position. In another embodiment, the pusher mechanism 200 may be configured to rotate in the same direction along a 360 degree circular path. In another embodiment, the pusher mechanism 200 can be configured to move linearly back and forth in order to move the print media along a media path.

As mentioned previously, the arm 215 is formed of a flexible material that has a memory. Upon being bent, the arm 215 should return to an original state. It will be appreciated that one or more arms 215 may be positioned along various points of the shaft 205. With multiple arms 215, the arms can be positioned such that they contact various points along the print media in an effort to uniformly eject the media. It will further be appreciated that each arm 215 may be configured in a variety of shapes and sizes. The arm 215 may be straight, be bent, include one or more angled portions, include one or more curves, or combinations of these. In one embodiment, the arm 215 can project out from the shaft 205 about two (2) inches.

It will also be appreciated that the shaft 205 may be formed with a variety of configurations, shapes, and cross-section configurations. For example; the shaft 205 may be an elongated rod that may include cross-sections that are circular, rectangular, triangular, non-uniformed cross-sections, and may have combinations of these along the length of the shaft 205. The shaft may include both uniformed sections and/or non-uniformed sections.

In one embodiment, the supporting device, shaft 205, is formed of a material different than the arms 215. For example, the shaft 205 may be formed of a generally non-flexible material such that it is stiff enough to provide a desired torque to the arms 215 during rotation. The supporting device has a general characteristic that it is formed of a material that is less flexible or otherwise more rigid than the material forming the arm 215. For example, the shaft 205 may be formed of a hard plastic, for example, a carbon based compound such as a polycarbonate material. Other types of materials may include polyurethane, polypropylene, or other types of materials, or compounds of these materials that have a sufficient hardness to provide a desired amount of torque for the pusher mechanism 200. The supporting device may also be formed of a metal such as aluminum or other type of metal that can support the flexible portion of the arm 215.

In one embodiment, the arm 215 is formed of a flexible elastomer. Various types of elastomers may be used, for example, thermoplastic polyurethanes. One example includes Elastollan® which is a polyester-based thermoplastic polyurethane made by BASF. Other examples may include santoprene, polypropylene, various types of rubbers, rubber-type compounds, synthetic materials, or other type of materials that have a sufficient amount of flexibility and memory to be repeatedly bent and be able to return to an original position. It will be appreciated that the arm 215 may include a flexible portion that can be the entire length of the arm or a different desired length.

Figure 3:
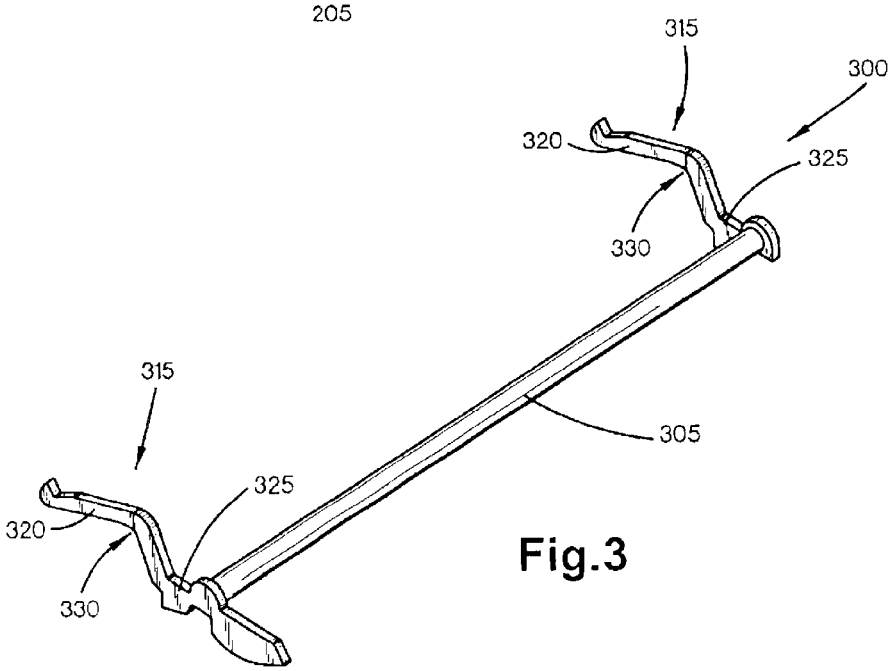
FIG. 3 illustrates a perspective view of another embodiment of a flexible media pusher.

Illustrated in FIG. 3 is a perspective view of another embodiment of a media pusher mechanism 300. This embodiment also applies as an ejection mechanism for ejecting the print media out from an image forming device. The media pusher 300 includes a supporting device, such as an elongated rod 305, connected to a plurality of arms 315 projecting out therefrom. Each arm 315 is formed of a flexible portion 320 shown as a flexible tip, and a base or connecting portion 325 that connects the flexible tip 320 to the rod 305. In one embodiment, the base 325 is formed integral with the rod 305 and of the same material. In general, the material of the rod 305 and base 325 are different and less flexible than the material forming the flexible tip 320. As mentioned previously, the rod 305 and base 325 are selected from materials having a sufficient stiffness to provide a desired amount of torque to the arms 315 to push print media.

The flexible tip 320 may be connected to the base 325 in a variety of ways. In one embodiment, the flexible tip 320 is integrally bonded to the base 325 without using an adhesive. This may be formed through a molding process where two different types of materials are injected into a mold, one material for the rod 305 and base 325 and the second material for the flexible tip 320. During molding, the two materials, while still in a molten state, bond together at a contact area represented by line 330. In this manner, the pusher mechanism 300 may be formed as a single integral unit. As such, the first and second materials are selected such that they have the properties allowing them to chemically bond together during molding without using a third material to affect the bond.

In another embodiment, the flexible tips 320 (or flexible arms 215 shown in FIG. 2) can be connected to the rod 305 in other ways such as by attachment using an adhesive or other bonding agent. Alternately, the rod 305 may be configured to attach the flexible arms 320 by, for example, snapping the arms into the rod 305 or by another mechanical connecting mechanism. It will be appreciated that the arm base 325 can have any desired length of the arm 315. Alternately, the base 325 may not be included such that the flexible portion 320 is connected directly to the rod 305.

Figure 4:
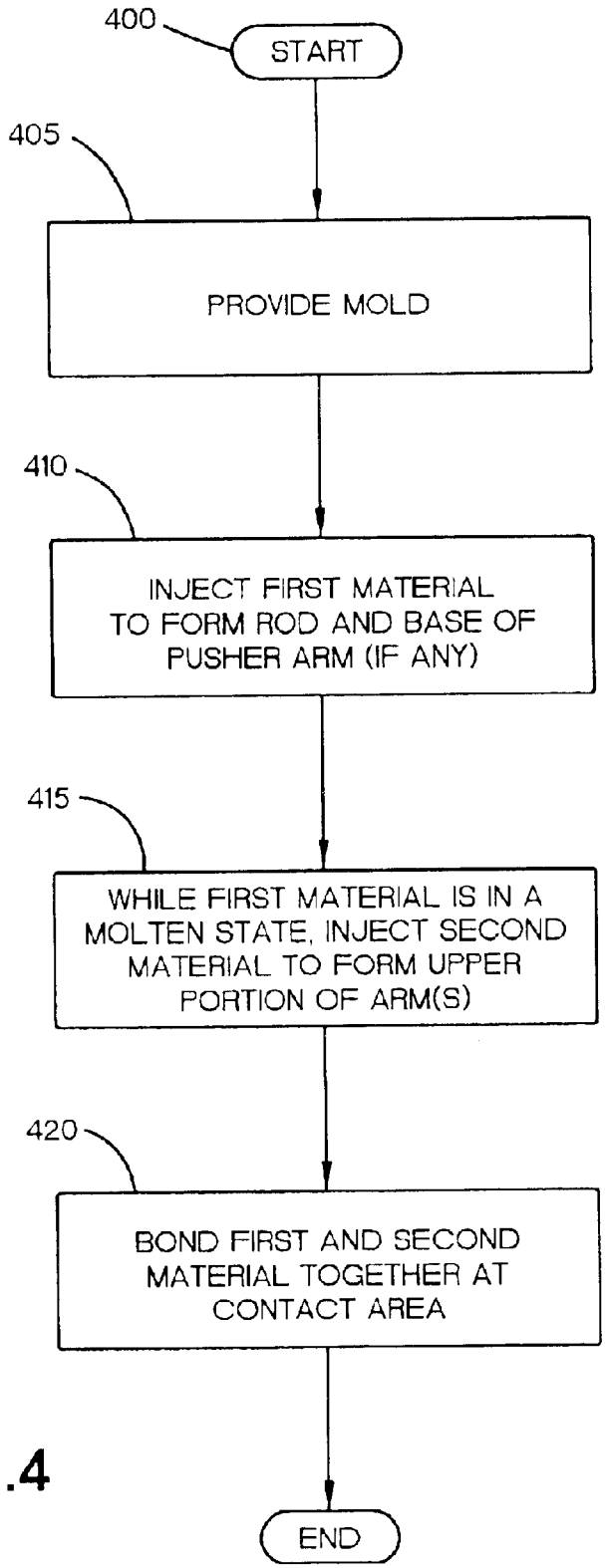
FIG. 4 illustrates one embodiment of a methodology for forming a flexible media pusher.

Illustrated in FIG. 4 is one embodiment of a methodology for manufacturing a media pusher mechanism shown in FIGS. 2, 3 or other type of configuration, as desired. The illustrated elements denote "processing blocks" and represent functions and/or actions taken for manufacturing the media pushing device. In one embodiment, the processing blocks may represent computer software instructions or groups of instructions that cause a computer to perform an action(s) and/or to make decisions that control another device or machine to perform the processing. It will be appreciated the methodology may involve dynamic and flexible processes such that the illustrated blocks can be performed in other sequences different than the one shown and/or blocks may be combined or, separated into multiple components. The foregoing applies to all methodologies described herein.

With reference to FIG. 4, one process 400 involves an injection molding process that includes providing a mold (block 405). For example, the mold can be a two-shot mold. The mold is configured with an elongated cavity for forming the elongated portion or rod of the mechanism, and one or more arm cavities extending out from and in fluid communication with the elongated cavity. A first material is injected into the elongated cavity to form the rod and pusher arm base portion (block 410). As mentioned previously, the first material is one that will have generally less flexibility or otherwise more rigid characteristics as compared to a second material used for the flexible portion of the arms.

After this first material is injected and while it is in a molten state, the second material is injected into the arm cavities to form the one or more arms (block 415). In another embodiment, the first and second materials may be co-injected. The first and second material, upon contacting and mixing together at a contact area, are bonded together (block 420). In one embodiment, the materials are chemically bonded together. It will be appreciated that depending on the properties of the first and second materials used, the timing of the injections and/or the temperature of the materials may affect the strength of the bond.

It will be further appreciated that while injecting the first material into the elongated cavity, the first material may enter the arm cavities to some extent thereby forming a base for the arms such as base 325 shown in FIG. 3. Of course, the flexible arms may be formed without such a base. The mold may also be designed to reduce or prevent movement of an injected material beyond a selected point. Once cured, the molded pusher will be formed with flexible arms chemically bonded to the elongated rod forming the pusher mechanism.

One example of the first material can be a polycarbonate and the second flexible material may be an elastomer such as Elastollan®. One type of Elastollan® may be Elastollan® C78A15 manufactured by BASF. One type of polycarbonate may be polycarbonate glass fibers and teflon. Another example includes a polycarbonate material bonded to a Santoprene, such as Santoprene grade 111-73, grade 8211-55B100, or other grades, manufactured by Advanced Elastomer Systems (AES). Another example of the first material may include a polypropylene and the second flexible material may be an elastomer, a Santoprene, or other flexible material. Of course, other materials and other combinations of material can be used. As previously mentioned, the first material may be a metal such as aluminum.

With the flexible media pusher, the flexible arms allow the pusher to bend without immediate damage, as such, accidental contact with the pusher arms by other components in the imaging device or by removal of media due to a paper jam has a lower likelihood of damaging the flexible arms. Although the media pusher has been described as an ejection mechanism positioned near the output of an imaging device, it may be used in other areas where movement of print media is desired.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

I claim:

1. An image forming device comprising:

an image forming mechanism for forming an image onto print media; and a media pusher having at least one flexible arm for moving the imaged print media along a media path and a supporting device for supporting the at least one flexible arm, the supporting device and the at least one flexible arm being formed from different materials having different flexibility properties.

2. The image forming device as set forth in claim 1 wherein the supporting device includes a shaft for supporting the at least one flexible arm, the at least one flexible arm extending out from the shaft.

3. The image forming device as set forth in claim 2 wherein the first material and the second material are chemically bonded together.

4. The image forming device as set forth in claim 2 wherein first material includes a rigid plastic and the second material includes an elastomer.

5. The image forming device as set forth in claim 2 wherein the at least one flexible arm is connected to the shaft at a base.

6. The image forming device as set forth in claim 2 wherein the shaft is formed of a first material being substantially non-flexible and the flexible arm is formed of a second material being flexible.

7. The image forming device as set forth in claim 3 wherein the base is integral with the at least one flexible arm.

8. The image forming device as set forth in claim 1 wherein the media pusher further includes a plurality of flexible arms.

9. The image forming device as set forth in claim 1 wherein the media pusher is an media pusher means for moving the print media along a media path.

10. The image forming device as set forth in claim 1 wherein the media pusher is configured to be rotatable between a start position and a end position, the flexible arm being rotatable from the start position to the end position while moving the imaged print media and being rotatable back to the start position in preparation for another imaged print media.

11. A mechanism for moving print media in an image forming device, the mechanism comprising:

an elongated rod configured to be rotated;

one or more arms extending out from the elongated rod and being configured to apply a force to print media to move the print media, the one or more arms including a flexible portion; and the elongated rod being formed of a material being substantially less flexible than the flexible portion such that the elongated rod can provide torque to the one or more arms when rotated.

12. The mechanism of claim 11 wherein the flexible portion has a flexible memory.

13. The mechanism of claim 11 wherein the flexible portion forms a tip of the one or more arms.

14. The mechanism of claim 11 further including a connecting portion between each of the one or more arms and the elongated rod, the connecting portion being formed of the material of the elongated rod.

15. The mechanism of claim 11 wherein the one or more arms are chemically bonded to the elongated rod.

16. The mechanism of claim 11 wherein the one or more arms are connected to the elongated rod.

17. The mechanism of claim 11 wherein the flexible portion includes an elastomer.

18. The mechanism of claim 11 wherein the one or more arms include a bent portion.

19. An image forming device comprising:

an image forming mechanism for forming an image onto print media; and an ejection means for ejecting the print media out from the image forming device after imaging, the ejecting means including a rigid portion for supporting a flexible portion configured to apply a force to the print media, where the rigid portion and the flexible portion are formed from different materials.

20. The image forming device as set forth in claim 19 where the rigid portion includes a supporting device means and the flexible portion includes at least one arm means extending out from the supporting device means.

21. The image forming device as set forth in claim 19 where the rigid portion and the flexible portion are chemically bonded together.

22. The image forming device as set forth in claim 19 where the flexible portion is formed from an elastomer.

* * * * *